US005411460A

United States Patent [19]

Karlson et al.

[11] Patent Number: 5,411,460

[45] Date of Patent: May 2, 1995

[54] MODULAR EXERCISE DEVICE WITH SELECTABLE RESISTANCE

[76] Inventors: Ricky Karlson; Robert Karlson, both of 5852 Sunrise Dr., Minneapolis, Minn. 55419

[21] Appl. No.: 160,891

[22] Filed: Dec. 1, 1993

[51] Int. Cl.[6] ..... A63B 21/008

[52] U.S. Cl. ..... 482/112

[58] Field of Search ..... 482/111, 121, 112, 113, 482/122, 126, 128, 131, 108, 114; 267/64.12

[56] References Cited

U.S. PATENT DOCUMENTS

| | | | |
|---|---|---|---|
| 1,023,756 | 4/1912 | Pons | 482/128 |
| 2,106,994 | 2/1938 | Chapman | 482/128 X |
| 3,834,696 | 10/1974 | Spector . | |
| 3,944,221 | 3/1976 | Berkestad . | |
| 3,955,655 | 5/1976 | Pornin . | |
| 4,148,479 | 4/1979 | Spector . | |
| 4,309,027 | 1/1982 | Mölders et al. | 267/64.12 X |
| 4,333,645 | 6/1982 | Wu | 482/112 |
| 4,351,527 | 9/1982 | Crisp, Jr. | 482/121 X |
| 4,517,966 | 5/1985 | von Othegraven | 482/125 X |
| 4,723,765 | 2/1988 | Pearson | 267/64.12 |
| 4,832,335 | 5/1989 | Tong . | |
| 4,880,230 | 11/1989 | Cook | 482/113 |
| 5,044,630 | 9/1991 | Ventimiglia . | |
| 5,069,448 | 12/1991 | Shyu | 482/112 |
| 5,071,119 | 12/1991 | Johnson | 482/112 |
| 5,242,349 | 9/1993 | Reiff et al. | 482/108 X |

*Primary Examiner*—Richard J. Apley
*Assistant Examiner*—John Mulcahy
*Attorney, Agent, or Firm*—Faegre & Benson

[57] ABSTRACT

An improvement to an exercise device of the type comprising a reciprocal pressurized gas unit with a pair of handles releasably attached to the opposite ends of the pressurized gas unit is described. The improvement to this type of exercise device comprises interengaging locking means at the second end of the cylinder and the second distal end of the piston rod, respectively, for locking the unit in a compressed position. The improvement also comprises means for having one handle fixed with respect to rotation of the gas pressurized unit and one handle rotatable with respect to the gas pressurized unit. The gas pressurized units may be interconnected with each other in either longitudinal alignment or in a T-shaped arrangement. Various attachments can be added to the exercise device including a massage element, a suction cup, a toroid shaped handle, a strap and a stirrup. The handles can be removed from the gas pressurized unit and attached to another gas pressurized unit of the same construction, but having an increased level of resistance to applied pressure.

13 Claims, 5 Drawing Sheets

MODULAR EXERCISE DEVICE WITH SELECTABLE RESISTANCE

FIELD OF THE INVENTION

This invention relates generally to an exercise apparatus which uses a gas cylinder to provide resistance in exercises involving either compression and/or extension efforts. More particularly, this invention relates to a modular exercise device with interchangeable parts to allow different types of isometric and isokinetic exercise and to provide different selectable levels of resistance according to the strength and level of training and ability of the individual.

DESCRIPTION OF THE PRIOR ART

Exercising devices of the kind comprising an elongate member having a handle at each end and being compressible, so that the handles can be moved toward each other against a resistance, are generally well know. Devices such as these have been found to be suitable both for exercise and muscle development, as well as for medical rehabilitation uses. Many of these devices employ some type of pressurized fluid containing unit to serve as the elongate member and to provide the needed resistance.

U.S. Pat. No. 3,834,696, Spector (I), relates to an exerciser having a two-part hydraulic chamber which allows oil to pass between two parts of the chamber to provide resistance to alternate linear compression and expansion strokes.

U.S. Pat. No. 3,944,221, Berkestad, et al., describes an exercise device having an air cylinder and a piston reciprocating within the cylinder. Non-return valves are provided, so that on repeated strokes, the resistance is progressively increased.

U.S. Pat. No. 3,955,655, Pornin, teaches an exerciser using a piston within a fluid filled chamber. The chamber has two sections connected by fluid-communication tubes. Resistance is provided on both compression and traction strokes.

U.S. Pat. No. 4,148,479, Spector (II), relates to an exercise device, similar to that of Spector (I), with certain safety and convenience modifications.

U.S. Pat. No. 4,333,645, Wu, describes an exerciser which uses a gas cylinder with two chambers divided by a piston and a narrow bore permitting passage of gas on alternate compression and expansion strokes. Resistance is provided to both compression and expansion of the exerciser.

U.S. Pat. No. 4,832,335, Tong, shows an exerciser capable of providing variable resistance by means of a generated air pressure opposed to a partial vacuum.

U.S. Pat. No. 5,044,630, Ventimiglia, relates to an exerciser for simultaneously resisting compression pressure of a user's hands, forearms and elbows.

Each of these exercises provides opportunity for a valuable workout, however none of these devices permits the addition or substitution of modular components to provide alternative positions and/or embodiments to add to the number of exercises or the parts of the body which can be developed. Also, none of these devices permits the interchange of the resistance means to use another resistance means of a different specific level of resistance.

SUMMARY OF THE INVENTION

This invention is an improvement to an exercise device of the type comprising a reciprocal pressurized gas unit with a pair of handles releasably attached to the opposite ends of the pressurized gas unit. The reciprocal pressurized gas unit includes a pressurized gas containing cylinder having a first end and a second end. The second end of the cylinder receives a piston rod slidingly therethrough. The piston rod has a first end retaining a piston for gas-tight reciprocal sliding within the cylinder. The piston rod has a second distal end. A pair of handles are releasably attached to the first end of the cylinder and the second distal end of the piston rod, respectively. The gas pressurized unit is reciprocal between a compressed position and an expanded position. The compressed position is achieved by applying compressive force on the first end of the cylinder against the second distal end of the piston rod toward each other, thereby urging the piston to compress the pressurized gas within the cylinder. The expanded position is achieved by release of the compressive force, thereby allowing the pressurized gas to expand against the piston.

The improvement to this type of exercise device comprises interengaging locking means at the second end of the cylinder and the second distal end of the piston rod, respectively, for locking the unit in the compressed position. The improvement also comprises having one handle fixed with respect to rotation of the gas pressurized unit and one handle rotatable with respect to the gas pressurized unit. The interengaging locking means on the second end of the cylinder may be accessible through a massage element. The gas pressurized units may be interconnected with each other in either longitudinal alignment or in a T-shaped arrangement. Various attachments can be added to the exercise device including a suction cup, a toroid shaped handle, a strap and a stirrup. The handles can be removed from the gas pressurized unit and attached to another gas pressurized unit of the same construction, but having an increased level of resistance to applied pressure.

DETAILED DESCRIPTION OF THE INVENTION

Figure 1:
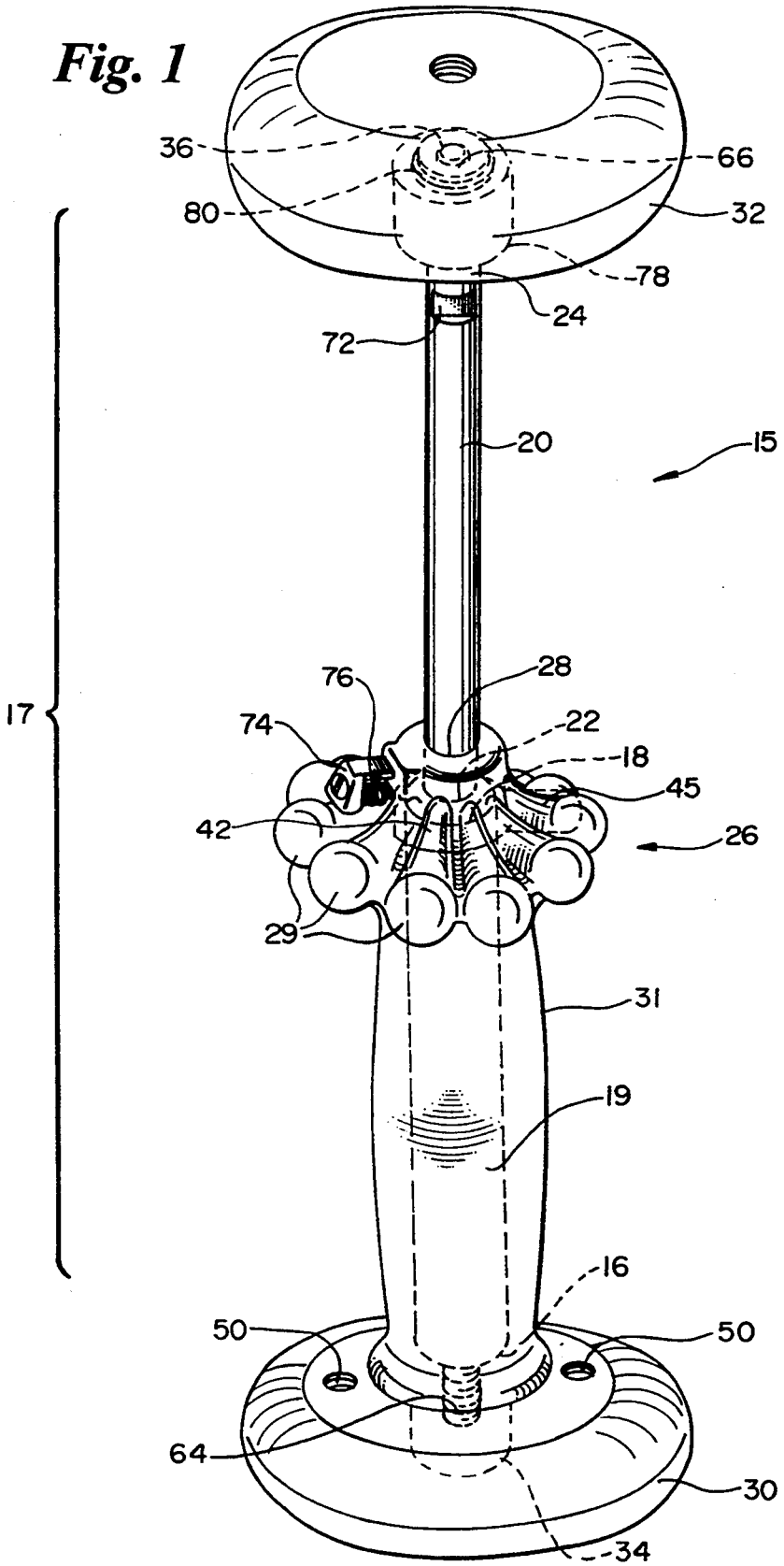
FIG. 1 illustrates a modular exercise device of the present invention with a single gas resistance unit.

FIGS. 1, 4, 5 and 9 illustrate a modular exercise device 15 of the present invention with a single reciprocal pressurized gas unit 17. The gas unit 17 includes a pressurized gas containing cylinder 19 having a first closed end 16 and a second closed end 18, receiving a piston rod 20 slidingly through the center of the second closed end 18. The piston rod 20 has a first end 22, retaining a piston (not shown) for gas-tight reciprocal sliding within the cylinder 19, and a second distal end 24. The first end 16 of the cylinder 19 and the second distal end 24 of the piston rod 20 terminate in screw threaded extensions 64 and 66, respectively. The cylinder 19 has a resilient exterior covering 31. Reciprocal pressurized gas units, such as unit 17, are well known and are commercially available, for example, from Suspa, Inc., Grand Rapids, Mich. Generally, gas cylinders designated by Suspa, Inc. as their Type 16 have been found suitable for the exercise devices of the present invention.

A generally circular denticulated massage element 26 is secured at the second end 18 of the cylinder 19. The massage element 26 has a central aperture 28 to slidingly receive the piston rod 20. As can be seen in FIGS. 1–5 and 9, the massage element 26 is symmetrically formed with protruding knobs 29, and can be used for a massaging action by maneuvering the exercise device 15 to roll the massage element 26 over a desired body surface area. The massage element 26 covers a cap member 42 which is secured on the second end 18 of the cylinder 19. The cap member 42 is shown in dotted line in FIG. 1. The structure and function of the cap member 42 will be described later herein in reference to FIGS. 9–13.

The handles 30 and 32, as seen in FIGS. 1–5, 9, 12 and 14, are generally solid, flat and round. The handle 30 is provided with a face plate 33 to centrally retain a screw-threaded receptacle 34 for screw engagement with the threaded extension 64 of the first end 16 of the cylinder 19. The screw-threaded receptacle 34 is fixed to the face plate 33, so that the handle 30, when screw-fit to the threaded extension 64 of the first end 16, is fixed with respect to rotation of the cylinder 19. The handle 32 is provided with a face plate 35 to centrally retain a screw-threaded receptacle 36 within the outer cylinder 78 for screw engagement with the threaded extension 66 of the second distal end 24 of the piston rod 20. The screw-threaded receptacle 36 on the handle 32, when screw-fit to the threaded extension 66 of the second distal end 24, is freely rotatable within the outer cylinder 78 and with respect to the piston rod 20. The structure and operation of the screw-threaded receptacle within the outer cylinder 78 which allows this free rotation will be described further later herein, particularly with respect to FIGS. 9, 12 and 13. It is to be understood that the handles 30 and 32 are interchangeable with each other in all respects, except that the handle 32 allows free rotation with respect to the attached gas resistance unit 17, while the handle 30 is fixed with respect to rotation of the attached gas resistance unit 17.

The modular exercise device 15 is reciprocal toward a compressed position (as shown by the dotted lines in FIG. 5) by compressive force on the handle 30 on the first end 16 of the cylinder 19 and the handle 32 on the second distal end 24 of the piston rod 20, relative to each other, thereby compressing the pressurized gas in the cylinder 19. From a compressed position, the modular exercise device 15 is reciprocal to an expanded position by release of the compressive force, thereby allowing the pressurized gas to expand against the piston, urging the piston rod 20 outward. The gas unit 17 provides resistance to the efforts of an individual on the ends of a modular exercise device according to the present invention on a compressive stroke. Since the compressed gas unit 17 responds slowly to a release of compressive pressure, the individual can increase his or her exercise by exerting traction to draw the expanding gas unit 17 outward.

Due to the screw engagement of the handles 30 and 32, the modular exercise device 15 can be easily transformed to a modular exercise device of a different level of resistance to compressive pressure by removing the handles 30 and 32 from the reciprocal pressurized gas unit 17 and screw engaging them to a reciprocal pressurized gas unit 37 having a different level of resistance. Removal of the handle 30 requires only simple unscrewing from the gas unit 17. Removal of the handle 32 will be described further later herein. Replacement of the pressurized gas unit 17 with a different gas unit 37 allows selective adjustment of the level of resistance to a particular individual and to the individual's level of strength and training.

It is to be understood that gas units 17 and 37 of different levels of resistance are in all respects, for the purposes of the present invention, structurally interchangeable with each other, except that the cylinder of a unit of a greater level of resistance has been charged by the manufacturer with a greater amount of pressurized gas. Any of the modular exercise devices of the present invention using more than one gas unit may use units of the same of different levels of resistance. Therefor, it is to be understood that whenever a gas resistance unit 17 is referred to, the discussion applies equally to a gas resistance unit 37 of a different level of resistance.

Figure 2:
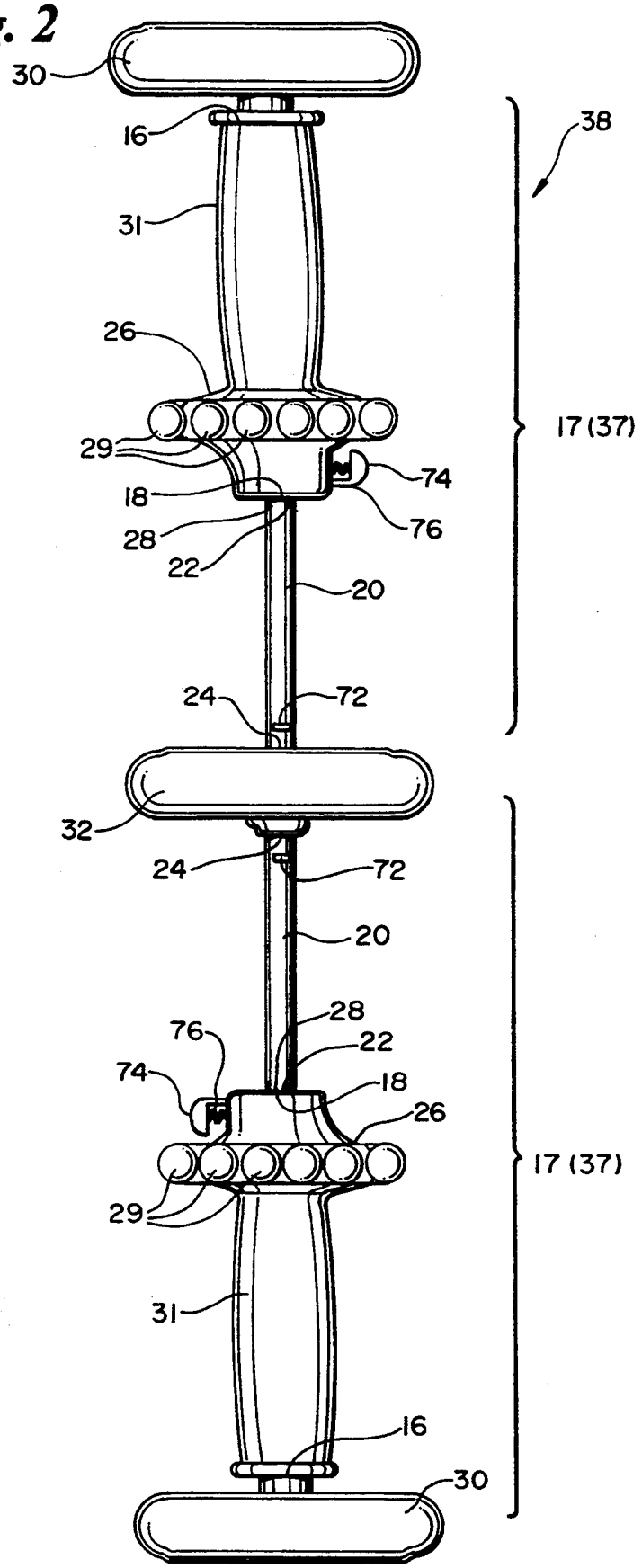
FIG. 2 shows a present modular exercise device with two gas resistance units connected in longitudinal alignment.

FIG. 2 shows a modular exercise device 38 of the present invention with two gas units 17 connected in longitudinal alignment. The gas units 17 may be of the same or different levels of resistance and may be interconnected with their cylinders 19 outermost (as shown in FIG. 2), with their piston rods 20 outermost, or with a cylinder 19 of one gas unit 17 and a piston rod 20 of another gas unit 17 outermost. To assemble the modular exercise device 38 as shown in FIG. 2, the screw threaded extensions 66 of the piston rods 20 of two gas units 17 are screwed into opposite sides of an annular-shaped handle 32. Annular-shaped handles 30 are each screwed onto the threaded extensions 64 of the first end 16 of each cylinder 19.

Figure 3:
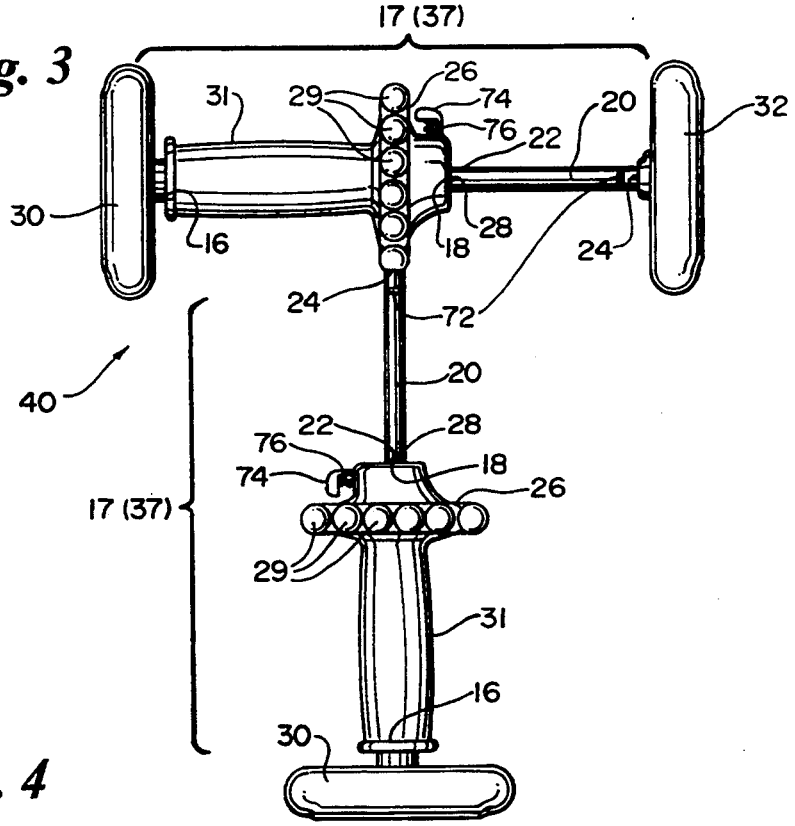
FIG. 3 shows a present modular exercise device with two gas resistance units connected in a T-shape.

FIG. 3 shows another modular exercise device 40 with two gas units 17 connected in a T-shape. The gas units 17 may be of the same or different levels of resistance. As can perhaps best be seen in FIGS. 1, 9 and 11, the cap member 42 is secured to the second end 18 of the cylinder 19. The cap member 42 has a threaded receptacle 44 accessible through a hole 45 in one of the knobs 29 on the massage element 26 to receive either the screw threaded extension 64 or the screw threaded extension 66. Also accessible deeper into the hole 45 is a hex head allen screw 47 which secures the cap member 42 to the second end 18 of the cylinder 19. The cap member 42 has an aperture 46 sized and positioned to permit free reciprocation of the piston rod 20. Note that, while FIG. 3 illustrates the modular exercise device 40 with the threaded extension 66 screwed to the threaded receptacle 44, a T-shaped exercise device may also be formed with the threaded extension 64 screwed to the threaded receptacle 44.

By substituting different gas units 17 or 37, and by interconnecting multiple gas units 17 (and/or 37) in longitudinal arrangement (as shown and described above with respect to FIG. 2) and/or in T-shaped arrangement (as shown and described above with respect to FIG. 3), other modular exercise devices according to the present invention may be assembled, thus adding to the level of resistance to compressive force, the variety of exercises and the areas of the body which may be exercised. This also permits use by individuals of differing levels of strength and training.

Figure 4:
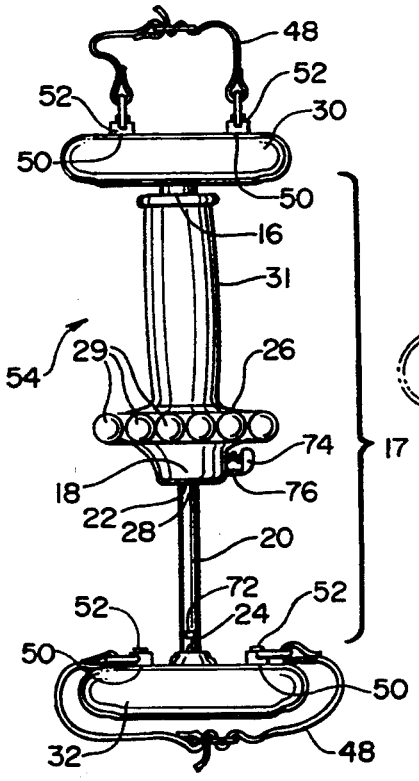
FIG. 4 shows optional strap handles.

FIG. 4 illustrates a modular exercise device 54 with straps 48 attached to the solid, flat and round handles 30 and 32. As can perhaps best be seen in FIG. 14, the strap 48 is secured to an aperture 50 in either handle 30 or 32 by means of a push-button actuated ball detent pin 52 at either end of the strap 48. It will be understood that a strap 48 can be connected to only one handle 30 or 32 if desired. There can be more than one aperture 50 on each of the handles 30 and 32 for retaining strap(s) 48 and the aperture(s) may be on either or both sides of the handles 30 and 32. The strap 48 allows the modular exercise device to be secured other than by grasping the handles 30 or 32.

Figure 5:
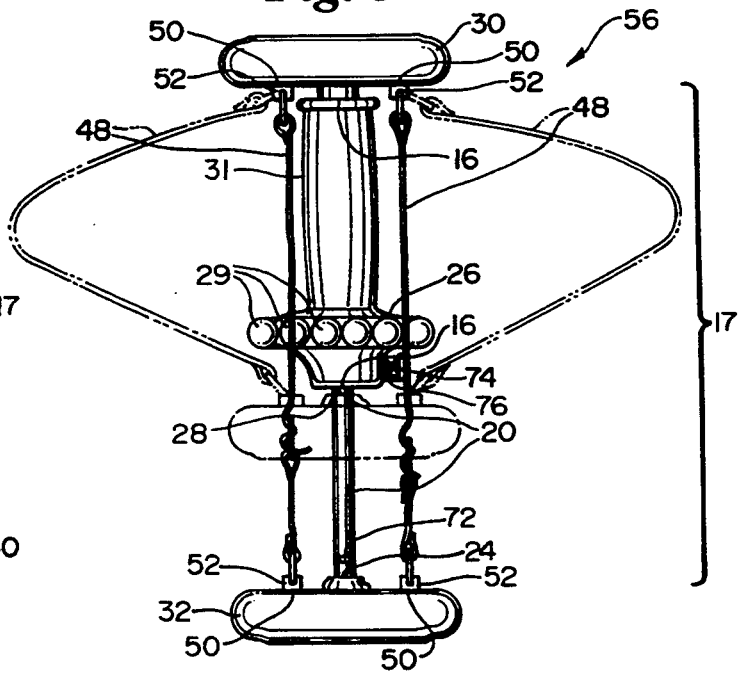
FIG. 5 shows two optional strap handles connected longitudinally in parallel.
Figure 14:
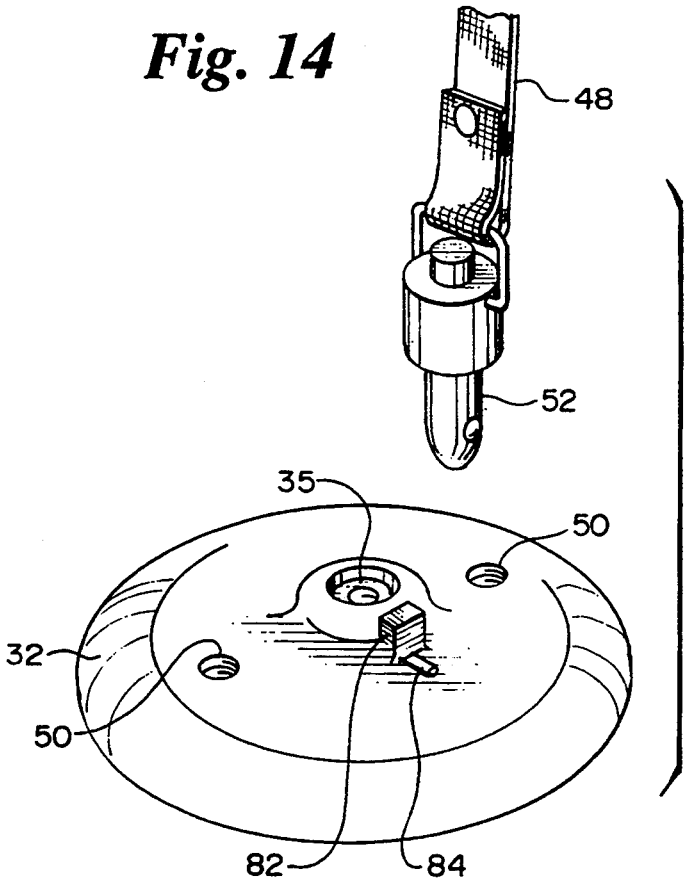
FIG. 14 shows a push-button actuated ball detent pin for connection of a strap to the annular-shaped handle.

FIG. 5 shows a modular exercise device 56 with two straps 48 connected longitudinally in parallel. Since the annular-shaped handle 30 is fixed with respect to rotation of the cylinder 19, and since the solid, flat and round handle 32 is freely rotatable with respect to the piston rod 20, parallel alignment of the two straps 48 is readily attained. Note that in the modular exercise device 56, pulling the straps 48 outward relative to each other compresses the cylinder 19 and the piston rod 20 relatively toward each other.

Figure 8:
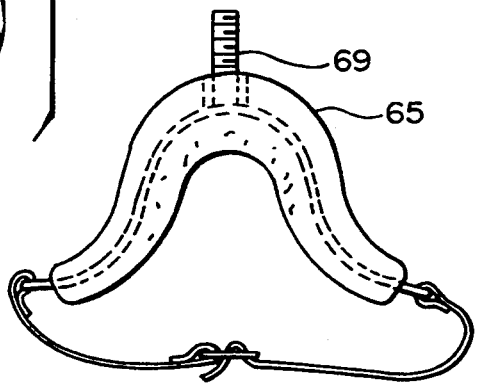
FIG. 8 shows an optional stirrup handle.
Figure 7:
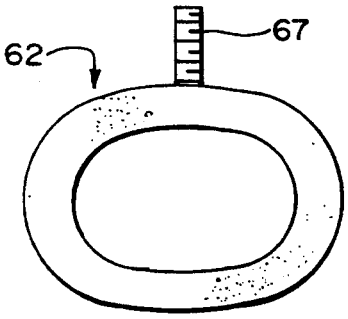
FIG. 7 shows an optional toroid-shaped handle.
Figure 6:
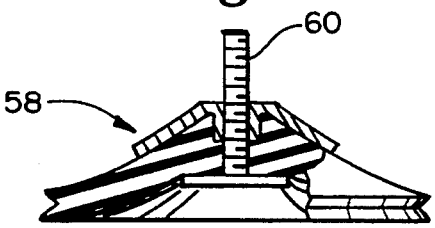
FIG. 6 shows an optional suction-cup.

FIG. 6 shows a suction-cup 58 with a screw threaded extension 60 which can be screwed to either solid, flat and round handle 30 or 32 opposite the handle's point of attachment to a gas unit 17. FIG. 7 shows a toroid-shaped handle 62 with a screw threaded extension 67 which can be screwed to either solid, flat and round handle 30 or 32 opposite the handle's point of attachment to a gas unit 17. FIG. 8 shows a stirrup 65 with a screw threaded extension 69 which can be screwed to either solid, flat and round handle 30 or 32 opposite the handle's point of attachment to a gas unit 17. The suction-cup 58, the toroid-shaped handle 62 and the stirrup 65 may be used in any combination and may be used with a single gas resistance unit 17 or with a plurality of gas resistance units 17 connected in any combination of a longitudinal or a T-shaped alignment.

Figures 9, 10, 11, 12, 13:
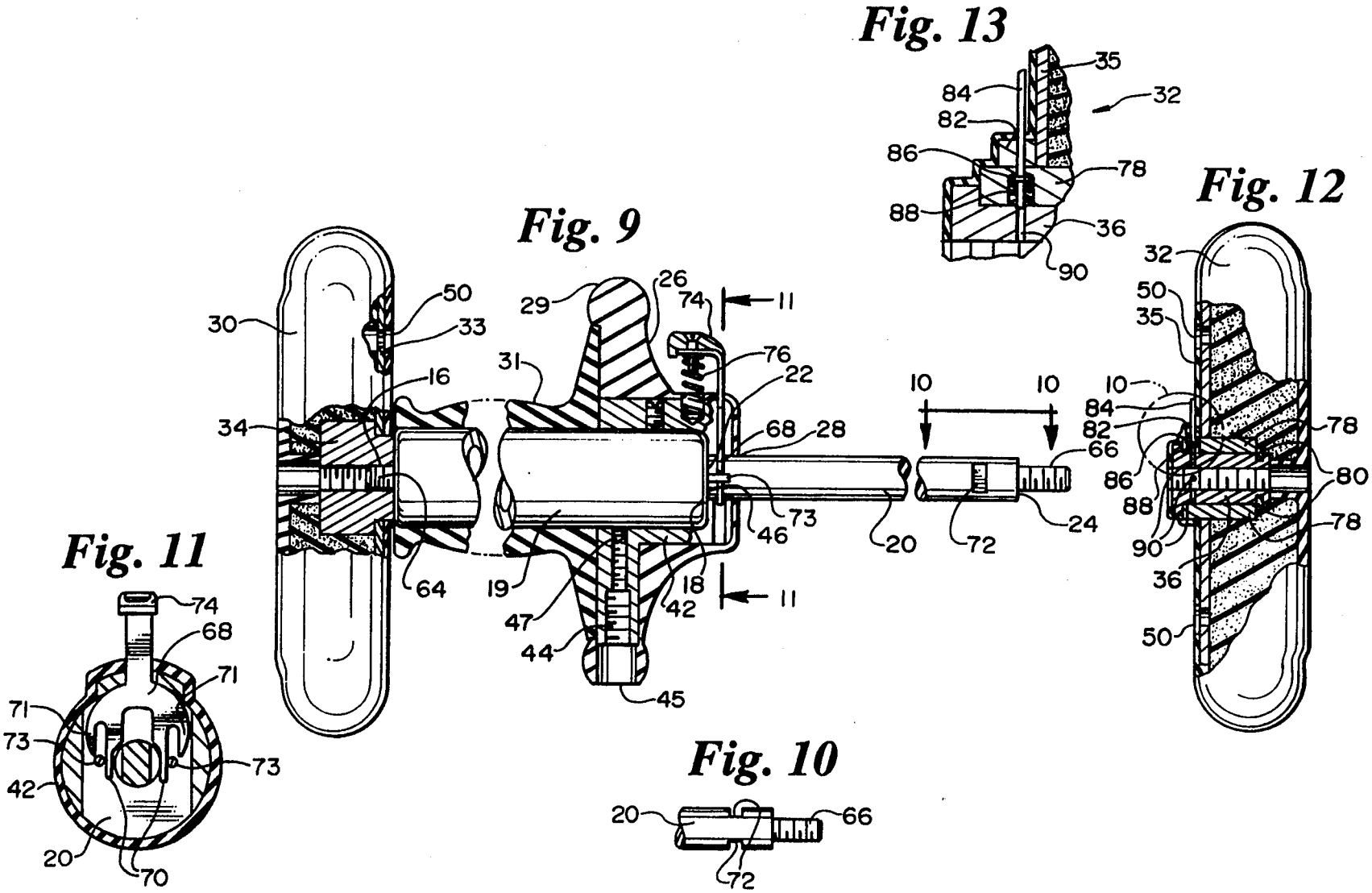
FIG. 9 shows a single gas resistance unit partially cut away to show interior fittings.
FIG. 10 is a sectional view of FIG. 9, taken along line 10—10.
FIG. 11 is a sectional view of FIG. 9, taken along line 11—11.
FIG. 12 shows a profile of one single annular-shaped handle, partially cut away to show interior fittings which allow free rotation of the handle relative to the gas resistance unit.
FIG. 13 is an enlarged view of the section shown in FIG. 12 within the circle 13.

FIG. 9 shows a single gas unit 17 partially cut away to show interior fittings. The screw-threaded receptacle 34 fixed to the face plate 33 in the center of the handle 30, when screw-fit to the threaded extension 64, is fixed with respect to rotation of the cylinder 19. The interior of the handle 30 is foam-rubber filled and the exterior has a resilient surface covering. If desired, the interior of the handle 30 may be weighted. The second end 18 of the cylinder 19 has a cap member 42. As has been described above, the cap member 42 has a threaded receptacle 44 accessible through a hole 45 in one of the knobs 29 on the massage element 26 to receive either of the screw threaded extensions 64 or 66 to form a T-shaped interconnection of the gas units 17 (and/or 37). The cap member 42 also has an aperture 46 sized and positioned to permit free reciprocation of the piston rod 20.

Positioned through the cap member 42 and the massage element 26, at a right angle to the longitudinal axis of the gas resistance unit 17, is a spring-loaded four-tined detent fork 68, which can perhaps best be seen in FIG. 11. The middle two tines 70 of the fork 68 have a thinner distal portion, such that the distance between the facing thinner distal portions of the middle two tines 70 snugly accommodates the exterior circumference of the piston rod 20. When the thinner distal portions of the middle two tines 70 seat around the exterior circumference of the piston rod 20, the fork 68 is at its furthest extension from the piston rod 20, with the spring 76 in its fully extended position. The fork 68 also has two outer tines 71. The second distal end 24 of the piston rod 20 has two notches 72 diametrically opposed to each other, which can also be seen in profile in FIG. 10.

By compressing the piston rod 20 within the cylinder 19, aligning the middle two tines 70 of the detent fork 68 with the notches 72, and manually depressing the button 74 on the spring 76, the middle two tines 70 are urged inward, until the wider portion of the middle two tines 70 seats within the notches 72. As the middle two tines 70 seat within the notches 72, each of the outer two tines 71 slides around a pin 73. The distance between the facing edges of the wider portion of the middle two tines 70 snugly accommodates the piston rod 20 between the notches 72. The distance between each middle tine 70 and its adjacent outer tine 71 snugly accommodates the pin 73. In this position, the pressure of the compressed gas in the cylinder 19 urging the piston 19 and piston rod 20 relatively outward serves to retain the detent fork 68 to lock the modular exercise device 15 in the compressed position. The engagement of the outer tines 71 with the pins 73 serves to stabilize the cylinder 19 and the piston rod 20 from rotation relative to each other. In this locked compressed position, the modular exercise device 15 can be used, for example, as a small dumbbell, and the device 15 takes less room for storage or transport. To release the device 15 from the compressed locked position, it is only necessary to slightly further compress the piston rod 20 within the cylinder 19 and spring-release the button 74 to allow the spring 76 to urge the detent fork 68 to its outermost unlocked position.

The arrangement which allows the handle 32 to freely rotate with respect to the piston rod 20 can perhaps best be seen by reference to FIGS. 12 and 13. The cylindrical screw-threaded receptacle 36 is retained within the outer cylinder 78 by the split-ring 80. The outer cylinder 78 is firmly retained against rotation within the face plate 35. In this position, the screw threaded receptacle 36 is able to rotate freely within the outer cylinder 78. When the piston rod 20 is retained within the screw threaded receptacle 36, the piston rod 20 and the handle 32 freely rotate relative to each other. A small block 82 is fastened to the exterior of the outer cylinder 78 and abuts the face plate 35. The block 82 is journaled to slidingly receive a pin 84. The pin 84 has a fixed plate 86 which seats against a spring 88 within the outer cylinder 78. Small bores 90 are at spaced intervals around the screw threaded receptacle 36. The small bores 90 are sized to slidingly receive the pin 84 and thus restrict rotation of the handle 32 relative to the piston rod 20. As has been described above, by compressing the piston rod 20 within the cylinder 19, aligning the middle two tines 70 of the detent fork 68 with the notches 72 and the outer two tines 71 with the pins 73, and manually depressing the button 74 against the spring 76, the detent fork 68 is urged inward, until the wider portion of the middle two tines 70 seats within the notches 72, thus locking the piston rod 20 within the cylinder 19. With the piston rod 20 locked within the cylinder 19, the operation of the pin 84 allows the handle 32 to be unscrewed from the piston rod 20 in the following manner. By applying pressure to the pin 84 while rotating the handle 32 relative to the piston rod 20, the pin 84 can be aligned to slip into one of the small bores 90. With the pin 84 held within one of the small bores 90, the screw-threaded receptacle 36 and the outer cylinder 78 are locked against rotation relative to each other. By maintaining pressure on the pin 84 within the small bore 90, the piston rod 20 can be unscrewed from the screw-threaded receptacle 36 in the handle 32.

The massage element 26, the resilient cover 31 on the cylinder 19, the resilient covers on the handles 30 and 32, the resilient covering on the suction cup 58, the toroid-shaped handle 62 and the stirrup 65 are all formed of a suitable resilient polymeric material, such as polyurethane. The face plates 33 and 35, the screw threaded receptacles 34 and 36, the cap member 42, the push button actuated ball detent pin 52, the face plate of the suction cup 58, the toroid-shaped handle 62, the stirrup 65, the detent fork 68, the button 74, the spring 76, the outer cylinder 78, the split ring 80, the block 82, the pin 84, the plate 86, and the spring 88 are all formed of a suitable metal, such as steel.

It will be apparent to one of ordinary skill in this art that there are a wide variety of configurations in which the modular exercise device of the present invention can be assembled and a variety of ways in which it can be used. The device 15 as shown in FIG. 1 can be used for compression and traction between the hands or between one hand and the upper arm. The device 38 offers a greater level of resistance and a longer range of movement with the arms. By fitting the device 38 with a long strap 48 fitted between the outermost handles 30 and 37, the device 38 can be used to strengthen the arms for such activities as archery. The device 40 can be positioned with the handle 30 of the gas unit 17 attached to the massage element 26, for example, against the abdominal muscles. With the hands on the remaining two handles 30 and 32, pressure can be exerted using both the hands and the abdominal muscles. The device 54 can be attached between the forearms, between the upper arms, between the calves or between the thighs. The device 54 can also be attached between the forearm and upper arm of one arm or between the calf and thigh of one leg. The device 56 can be used by pulling the straps outward. Use of the suction cup 58 will allow removably attaching the exercise device to any suitable flat surface, such as a wall, floor or table. Use of the toroid-shaped handle 62 allows firmer grasping with the hands and allows more secure grasping by individuals with smaller hands. Use of the stirrup 65 allows use of the exercise device against the foot.

What is claimed is:

1. In an exercise device of the type comprising:

a reciprocal pressurized gas unit including a pressurized gas-containing cylinder having a first end and a second end, said gas-containing cylinder receiving a piston rod slidingly therethrough, said piston rod having a first end retaining a piston for gas-tight reciprocal sliding within said cylinder and said piston rod having a second distal end;

a pair of handles releasably attached to said first end of said cylinder and said second distal end of said piston rod, respectively;

said unit reciprocal between a compressed position and an expanded position, wherein said compressed position is achieved by application of compressive force on said first end of said cylinder against the second distal end of the piston rod toward each other, thereby urging said piston to compress said pressurized gas within said cylinder, and wherein said expanded position is achieved by release of said compressive force from said compressed position, thereby allowing said pressurized gas to expand against said piston;

the improvement comprising:

said second end of said cylinder and said second distal end of said piston rod, respectively, are further provided with interengaging locking means for locking said unit in said compressed position;

wherein one of said pair of handles is fixed with respect to rotation of said unit and another of said pair of handles is rotatably mounted with respect to said unit; and wherein one of the pair of handles of the unit releasably receives either (a) a first end of a cylinder of a second pressurized gas unit or (b) a second distal end of a piston rod of a second pressurized gas unit, so that said exercise device has two pressurized gas units attached to each other in longitudinal alignment with each other.

2. The invention according to claim 1, wherein the interengaging locking means on the second end of the cylinder is a spring-actuated fork and the interengaging locking means on the second distal end of the piston rod is a pair of notches for engaging the fork.

3. The invention according to claim 1, wherein the second end of the cylinder is further provided with a massage element.

4. The invention according to claim 1, wherein at least one handle is a flat and round shaped member.

5. The invention according to claim 1, wherein at least one handle comprises a weight.

6. The invention according to claim 1, wherein the cylinder is exteriorly provided with a resilient cover.

7. The invention according to claim 1 wherein at least one handle is a strap.

8. The invention according to claim 1, wherein each handle is further provided with strap-retaining means and ends of a strap are each retained by a separate handle.

9. The invention according to claim 1, wherein at least one handle has a resilient covering.

10. The invention according to claim 1, wherein at least one handle has releasable suction means.

11. The invention according to claim 1, wherein at least one handle is toroid-shaped.

12. The invention according to claim 1, wherein at least one handle is a stirrup.

13. In an exercise device of the type comprising:

a reciprocal pressurized gas unit including a pressurized gas containing cylinder having a first end and a second end and receiving a piston rod slidingly therethrough, said piston rod having a first end retaining a piston for gas-tight reciprocal sliding within said cylinder and said piston rod having a second distal end;

a pair of handles releasably attached to said first end of said cylinder and said second distal end of said piston rod, respectively;

said unit reciprocal between a compressed position and an expanded position, wherein said compressed position is achieved by application of compressive force on said first end of said cylinder against said second distal end of said piston rod toward each other, thereby urging said piston to compress said pressurized gas within said cylinder, and wherein said expanded position is achieved by release of said compressive force from said compressed position, thereby allowing said pressurized gas to expand against said piston;

the improvement comprising a T-shaped exercise device wherein:

said second end of said cylinder and said second distal end of said piston rod, respectively, are provided with interengaging locking means for locking said unit in said compressed position;

wherein one handle is fixed with respect to rotation of said unit and one handle is rotatably mounted with respect to said unit; and wherein said second end of said cylinder releasably receives either (a) a first end of a cylinder of a second pressurized gas unit or (b) a second distal end of a piston rod of a second pressurized gas unit, so that said T-shaped exercise device has two pressurized gas units attached to each other in a generally perpendicular orientation to each other.

* * * * *

UNITED STATES PATENT AND TRADEMARK OFFICE

CERTIFICATE OF CORRECTION

PATENT NO. : 5,411,460

DATED : May 2, 1995

INVENTOR(S) : Ricky Karlson and Robert Karlson

It is certified that error appears in the above-indentified patent and that said Letters Patent is hereby corrected as shown below:

Column 8, Line 3: Delete the word "said" and insert --the--

Column 8, Line 4: Delete the word "said" and insert --the--

Column 8, Line 6: Delete the word "said" and insert --the--

Column 8, Line 7: Delete the word "said" and insert --the--

Column 8, Line 8: Delete the word "said" and insert --the--

Column 8, Line 9: Delete the word "said" and insert --the-- in all occurrences

Column 8, Line 11: Delete the word "said" and insert --the--

Column 8, Line 12: Delete the word "said" and insert --the--

Column 8, Line 14: Delete the word "said" and insert --the-- in all occurrences

Column 8, Line 16: Delete the word "said" and insert --the--

Column 8, Line 17: Delete the word "said" and insert --the-- in all occurrences

Column 8, Line 18: Delete the word "said" and insert --the--

UNITED STATES PATENT AND TRADEMARK OFFICE

CERTIFICATE OF CORRECTION

PATENT NO. : 5,411,460
DATED : May 2, 1995
INVENTOR(S) : Ricky Karlson and Robert Karlson It is certified that error appears in the above-indentified patent and that said Letters Patent is hereby corrected as shown below:

| | |
|---|---|
| Column 8, Line 19: | Delete the word "said" and insert --the-- in all occurrences |
| Column 8, Line 20: | Delete the word "said" and insert --the-- |
| Column 8, Line 21: | Delete the word "said" and insert --the-- |
| Column 8, Line 23: | Delete the word "said" and insert --the-- in all occurrences |
| Column 8, Line 24: | Delete the word "said" and insert --the-- |
| Column 8, Line 26: | Delete the word "said" and insert --the-- in all occurrences |
| Column 8, Line 27: | Delete the word "said" and insert --the-- |
| Column 8, Line 28: | Delete the word "said" and insert --the-- in all occurrences |
| Column 8, Line 30: | Delete the word "said" and insert --the-- |
| Column 8, Line 35: | Delete the word "said" and insert --the-- |
| Column 9, Line 2: | Delete the word "said" and insert --the-- |
| Column 9, Line 4: | Delete the word "said" and insert --the-- in all occurrences |

UNITED STATES PATENT AND TRADEMARK OFFICE

CERTIFICATE OF CORRECTION

PATENT NO. : 5,411,460
DATED : May 2, 1995
INVENTOR(S) : Ricky Karlson and Robert Karlson It is certified that error appears in the above-indentified patent and that said Letters Patent is hereby corrected as shown below:

Column 9, Line 6: Delete the word "said" and insert --the--

Column 9, Line 7: Delete the word "said" and insert --the-- in all occurrences

Column 9, Line 9: Delete the word "said" and insert --the--

Column 9, Line 10: Delete the word "said" and insert --the--

Column 9, Line 12: Delete the word "said" and insert --the-- in all occurrences

Column 9, Line 13: Delete the word "said" and insert --the-- in all occurrences

Column 9, Line 14: Delete the word "said" and insert --the--

Column 9, Line 15: Delete the word "said" and insert --the-- in all occurrences

Column 9, Line 16: Delete the word "said" and insert --the--

Column 9, Line 17: Delete the word "said" and insert --the-- in all occurrences

Column 10, Line 1: Delete the word "said" and insert --the--

Column 10, Line 2: Delete the word "said" and insert --the--

UNITED STATES PATENT AND TRADEMARK OFFICE

CERTIFICATE OF CORRECTION

PATENT NO. : 5,411,460
DATED : May 2, 1995
INVENTOR(S) : Ricky Karlson and Robert Karlson It is certified that error appears in the above-indentified patent and that said Letters Patent is hereby corrected as shown below:

Column 10, Line 5: Delete the word "said" and insert --the-- in all occurrences

Column 10, Line 6: Delete the word "said" and insert --the--

Column 10, Line 7: Delete the word "said" and insert --the--

Column 10, Line 8: Delete the word "said" and insert --the--

Column 10, Line 10: Delete the word "said" and insert --the--

Column 10, Line 11: Delete the word "said" and insert --the--

Column 10, Line 12: Delete the word "said" and insert --the-- in all occurrences Column 10, Line 16: Delete the word "said" and insert --the--

Signed and Sealed this

Fifth Day of December, 1995

*Attest:*

*Attesting Officer*

Bruce Lehman

BRUCE LEHMAN

*Commissioner of Patents and Trademarks*